US005621701A

United States Patent [19]

Denaro et al.

[11] Patent Number: 5,621,701

[45] Date of Patent: Apr. 15, 1997

[54] CONTROLLED COMPLIANCE ACOUSTIC BAFFLE

[75] Inventors: Alfred Denaro, Commack; Thomas J. Bertram, Garden City Park; John D. Lea, Huntington, all of N.Y.

[73] Assignee: Lockheed Martin Tactical Systems, Inc., Bethesda, Md.

[21] Appl. No.: 391,901

[22] Filed: Aug. 10, 1989

[51] Int. Cl.[6] ..... H04R 23/00

[52] U.S. Cl. ..... 367/151; 367/191; 367/176; 181/286; 181/207

[58] Field of Search ..... 367/1, 151, 162, 367/176, 191; 181/0.5, 207, 208, 284, 286

[56] References Cited

U.S. PATENT DOCUMENTS 4,683,979 8/1987 Ghibu et al. ..... 367/191

FOREIGN PATENT DOCUMENTS 2522052 8/1983 France ..... 181/284
2743980 4/1979 Germany ..... 181/284

*Primary Examiner*—J. Woodrow Eldred
*Attorney, Agent, or Firm*—Arnold L. Albin; Seymour Levine; Stantn D. Weinstein

[57] ABSTRACT

An acoustic baffle for reflecting sound waves and rejecting background interference noise for use with a hydrophone array. The baffle utilizes a plurality of lenticular resilient elements embedded in a compliant foam elastomer compound. The embedded elements provide control of overall baffle compliance for submarine applications, particularly for high hydrostatic pressure operation. The resilient members are formed from pairs of resilient lenticular shaped elements which are integrally bonded to a highly damped constrained viscoelastic layer to provide uniform noise reduction performance over a broad frequency range. The pairs of elements are joined at their ends by compliant end caps which provide minimum constraint on the motion of the ends, thus limiting bending stresses in the elements. The members are designed to freely deflect up to a maximum operating depth, at which point the elements bottom and no further deflection occurs, thereby assuring that deflections of the members do not exceed a design limit, even when the apparatus is tested at depths exceeding its operating range.

10 Claims, 3 Drawing Sheets

CONTROLLED COMPLIANCE ACOUSTIC BAFFLE

BACKGROUND OF THE INVENTION

1. Field of the Invention

The invention relates generally to an underwater acoustic reflector for use with a hydrophone assembly and, more particularly, to an acoustic baffle providing high compliance in a liquid medium under high hydrostatic pressure.

2. Description of the Prior Art

It is well known that self-noise resulting from noise generating mechanisms such as machinery and induced vibrations in the hull structure of a submarine, reduce the signal to background noise ratio in a hydrophone array. Acoustic baffles, either of the reflective or absorptive type, have been used with sonar arrays to discriminate against such noise sources. Sound energy impinging on a compliant (or low impedance) baffle layer mounted behind a hydrophone array and outboard the hull of a vessel will cause energy on the submarine side to be reflected back away from the hydrophones because of the impedance discontinuity. However, baffles which are too highly compliant, while yielding good shallow depth performance, can quickly "bottom out" and thereby lose their effectiveness at medium depths.

Common types of wholly compliant baffles consist of rubber tiles with various size air pockets. Under increasing hydrostatic pressure, the soft walls of the air pocket enclosures buckle and pocket coverings deflect quickly, reaching a bottoming or non-operational condition at a shallow ocean depth. Making the linings of the pockets stiffer or adding particles of lead shot to the pockets provide some increase in operational depth capability, although limited.

Other methods, such as inclusion of springs within the rubber compound to limit overall compliance and extend performance to reasonable depths have also been attempted, as in U.S. Pat. No. 3,277,434. In U.S. Pat. No. 3,907,062, a compliant baffle provided with an acoustically harder outer surface material had embedded therein a plurality of tubes capable of withstanding the required hydrostatic pressure without collapse, but compliant to the noise frequencies encountered. However, this design has several shortcomings. The tubes are tuned to resonate and because they have little inherent damping they yield non-uniform noise reduction, being effective only in a limited frequency band. Staggering tubes of different sizes and resonant frequencies in horizontal and vertical arrays, while providing a broader frequency band performance, does not alleviate the non-uniformity of response problem due to the limited damping.

A further problem with the above cited art is that the compliance mechanism of the embedded tubes is equivalent to that of a series of beams with both ends fixed, with the beam deflecting under application of uniform pressure loading. This fixed end design is susceptible to high stress concentrations at the ends, which tends to result in early fatigue failure when subjected to cyclic pressure stressing. Further, since such tubes are likely to be fabricated of a non-metallic material such as fiberglass or carbon reinforced plastic laminate for minimizing weight (of critical importance in submarine array design), the tubes must be greatly derated with respect to the allowable stress loading, thereby limiting the operational depth of the baffle. Moreover, the nature of this arrangement is such that the tubes do not bottom, but continue to deflect and are therefore subjected to increased bending stress when loaded to a test pressure or depth (which may be greater than the maximum operational pressure), thus further limiting the utility for deep depth operation at high hydrostatic pressures.

The present invention utilizes a highly compliant polymer in which are embedded a plurality of damped spring elements having a predetermined maximum deflection, thereby providing high acoustic efficiency while resisting pressures beyond the operational depth of the hydrophone array.

SUMMARY OF THE INVENTION

The acoustic baffle of the present invention comprises a fluid impermeable enclosure of a compressible medium within which are located an assembly of lenticular shaped resilient members longitudinally disposed in a parallel array. The resilient members are adapted for controlling the compliance of the baffle by symmetrically and linearly deflecting in response to an impinging acoustic wave or pressure loading from the liquid environment. The lenticular members are further embedded within a second compliant material that determines the extent of compliance at a first operating pressure range, such as a shallow to medium depth, and the members are constructed to have a further compliance so that a maximum deflection is achieved at a second operating pressure corresponding to a maximum depth of operation. By bottoming out at the maximum deflection, the members are not subjected to increased bending stresses at test pressures greater than the designed operating pressure, and therefore serve to prevent any permanent deformation or loss of compliance. The improved performance at deeper depths is obtained by forming the resilient members in a complementary convex shape comprised of a pair of curved resilient elements bonded by a viscoelastic layer. This highly damped constrained viscoelastic layer provides for the uniformity of this noise reduction over a broad frequency band. Pairs of the bonded resilient elements are assembled and may be stacked horizontally or vertically to provide a predetermined compliance. A compliant end cap adjoining each end of each pair of resilient members provides lateral containment of the members while allowing free relative motion of the ends thus preventing bending stresses in the longitudinal direction of the spring elements.

DESCRIPTION OF THE PREFERRED EMBODIMENT

Figure 1:
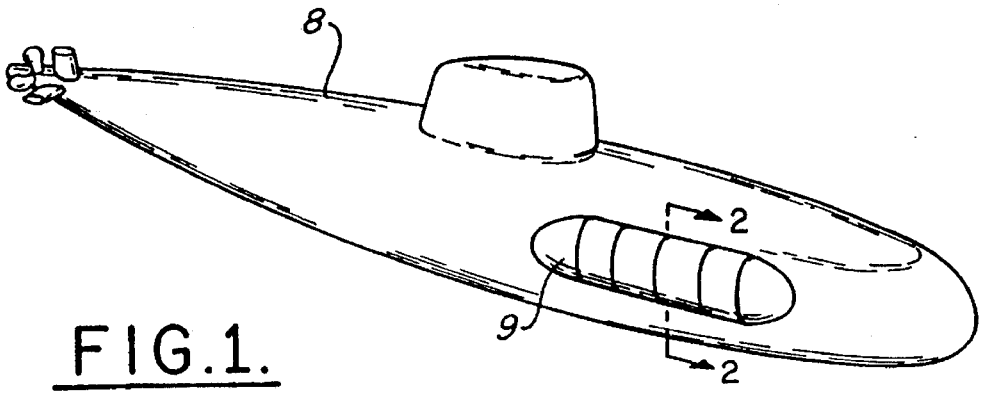
FIG. 1 is a perspective view of a controlled compliance acoustic baffle hydrophone array installed outboard the hull surface of a submarine.
Figure 2:
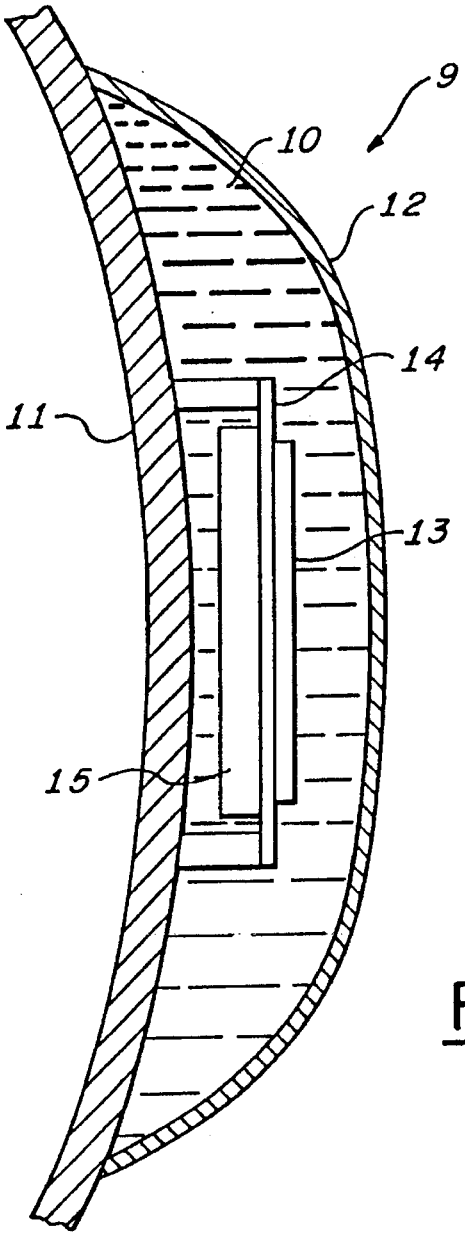
FIG. 2 is a view in section of the baffle and hydrophone array of FIG. 1.

Referring now to FIG. 1, there is shown a submarine 8 including a hydrophone array 9. As shown most clearly in FIG. 2, the hyrophone array 9 is located in a seawater flooded compartment 10 between a pressure hull 11 and the exterior hull 12 of the submarine 8. The hydrophone array 9 is comprised of a sensing element 13, a signal conditioner plate 14, and an acoustic baffle 15. The acoustic baffle 15 may be affixed to the inboard side of the signal conditioner plate 14 and the hydrophone sensing element 13 is affixed to the outboard side by any known means, such as by adhesives, brackets, etc. The function of baffle 15 is to reduce noise conducted and radiated from the mechanical apparatus and vibrations within the submarine, thereby limiting the amount of noise that is received by the hydrophone sensing element 13.

A measure of the sound reduction performance of an acoustic baffle (insertion loss in dB) is to a large extent related to its compliance. The compliance is a measure of the bulk modulus; that is, the inverse ratio of the rate of volume change of the baffle to change in external pressure. Therefore, a highly compliant baffle will exhibit a large rate of volume change with a small change in external pressure. Sound energy impinging on a highly compliant baffle layer mounted behind a hydrophone array will cause energy to be reflected back away from the hydrophone sensors. This is attributed to the impedance discontinuity, the water representing the high impedance, while the baffle is designed to afford a low impedance due to its high degree of compliance. The mechanism of energy reflection is based on the relationship of the characteristic impedances of the two media (water and baffle) in which the sound wave is passing through. As is well known in the art, the standard relationship of reflected sound energy ($I_r$) to normal incident energy ($I_i$) is as follows:

$$\frac{I_r}{I_i} = \left[ \frac{\rho_2 C_2 - \rho_1 C_1}{\rho_2 C_2 + \rho_1 C_1} \right]^2$$

where:

$\rho_1 C_1$=specific acoustic impedance of medium 1 (water)

$\rho_2 C_2$=specific acoustic impedance of medium 2 (baffle)

$\rho$=mass density

C=speed of sound in medium

Since the acoustic impdance of water is high (154,000 gm/cm$^2$ sec), a baffle which has a much lower acoustic impedance can maximize reflected energy.

The impdance of the baffle can also be expressed by the following:

$$(\rho C) = \sqrt{\rho B}$$

where B is the bulk modulus of the baffle. Accordingly, a lightweight baffle which is compliant (high change in volume under pressure), will result in a low acoustic impedance. For baffles, which tend to be large in area and short in height, its deflection under pressure is a good measure of bulk modulus. As noted above, however, baffles which are too highly compliant, while yielding good performance at shallow depths, can quickly bottom out and lose their effectiveness at more moderate depths.

Other factors such as baffle thickness, mass, damping and sound energy incident angle can also affect the acoustic performance of a baffle.

Figure 3:
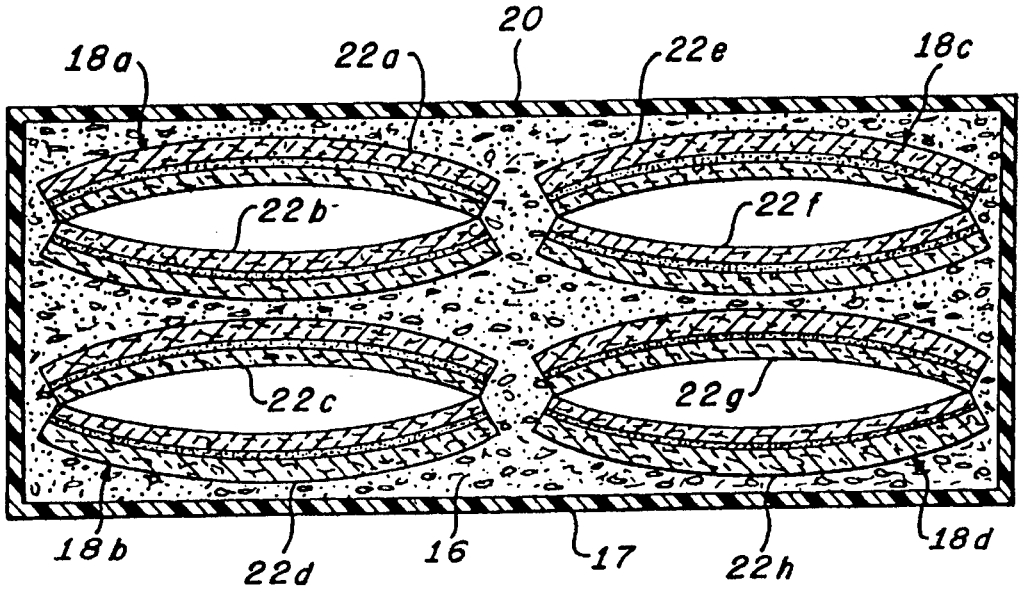
FIG. 3 is a detailed sectional view of the baffle of the present invention with emphasis on the delineation of various resilient elements and a compliant embedment.

Referring now to FIG. 3, there is shown a view in cross-section of the acoustic baffle 15. The baffle is comprised of a compressible medium 16 which may be a compliant elastomer containment material, within which are embedded a plurality of horizontally and vertically stacked resilient members 18. Preferably, the containment material is comprised of a high density polyurethane cellular foam. Other elastomer materials, such as chloroprene, can be used, provided they secure the shell assemblies, are durable to withstand high hydrostatic pressure at great water depths, and exhibit sufficient compliance in response to impinging sound energy. A compliant jacket 20 is used to contain the encapsulant and resilient shell assemblies and provide resistance to a sea water environment. An ether base polyurethane is the preferred jacket material, since it is durable and flexible and will resist the seawater and the effects of repeated flexing due to the many depth changes which are likely to be encountered during operation of a submarine. Other elastomer materials may be employed provided they exhibit these properties. The encapsulating jacket 20 is preferably provided with a planar outer surface 17 for mounting to the hydrophone structure.

The baffle 15 includes a shell assembly of resilient members 18*a*–18*d*. The assembly comprises a lenticular shaped member including a pair of substantially identical upper and lower spring members 22*a*–22*h* which are positioned together in convex opposition and interlocked by end caps (not shown). The spring members 22*a*–22*h* have a circumferential axis along the line of curvature and a longitudinal axis orthogonal thereto.

Figure 4:
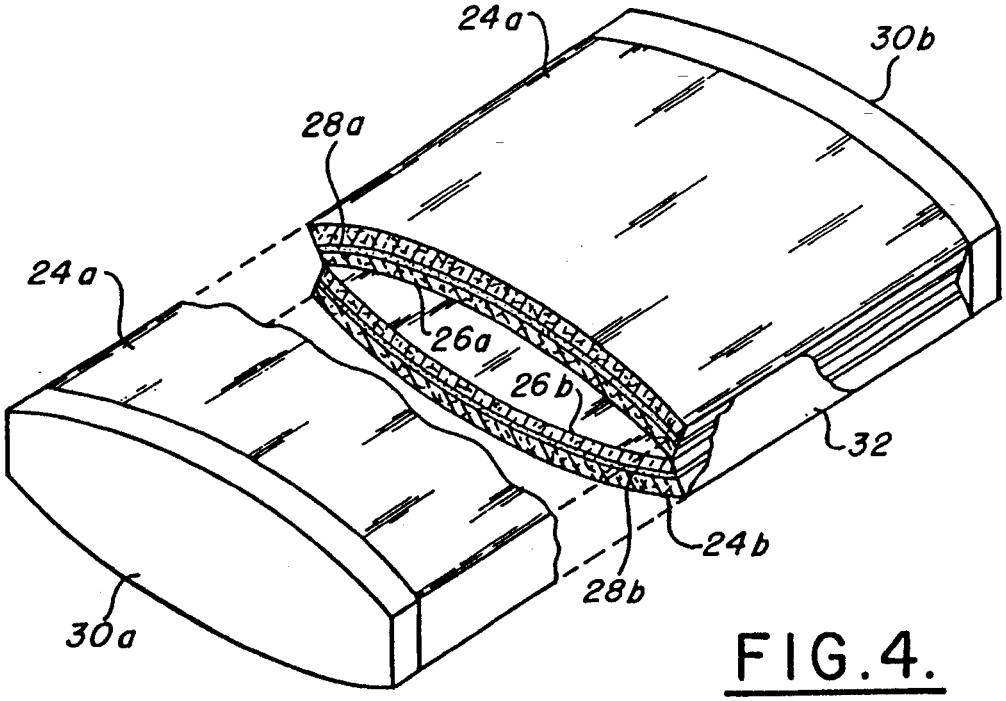
FIG. 4 is a perspective view, partially in section, showing the position of resilient elements comprising the baffle of FIG. 3.
Figure 5A:
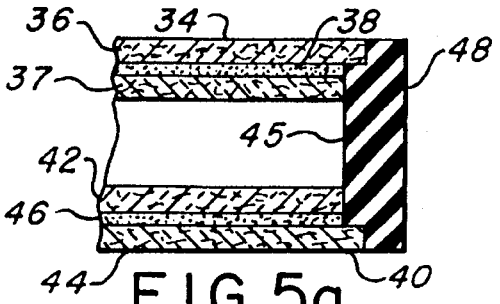
FIG. 5A and FIG. 5B show a detailed view in cross-section of an end cap assembly for the spring elements of FIG. 4 before and after pressure loading.
Figure 5B:
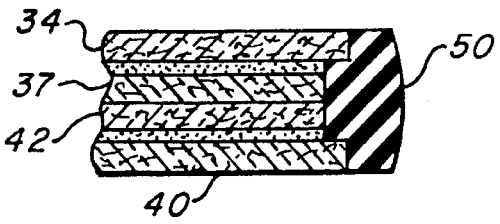

As may be seen most clearly from FIG. 4, spring members 22*a*–22*h* comprise pairs of complementary convex curved spring elements 24*a*, 24*b*, 26*a*, 26*b*, which are respectively bonded by an elastic epoxy adhesive (not shown) to viscoelastic damping layers 28*a*, 28*b*, which may be a rubber or vinyl compound exhibiting a high damping factor. Preferably, the assembly of spring elements 24, 26, and layer 28 are provided with resilient end caps 30*a* and 30*b* and the end caps and longitudinal edges of the assembly are sealed by application of a polysulphide rubber or polyurethane sealant 32. The end caps 30*a* and 30*b* may be fabricated of a preferred cellular polyurethane foam material similar to the preferred containment material 16 of the baffle. This material as well as its molded shape are designed to provide containment at the ends of the spring plates without constraining its motion under pressure loading. This feature may be seen more clearly in FIGS. 5A and 5B. In FIG. 5A, an upper shell assembly 34, which is comprised of a first resilient element 36, a second resilient element 37 and an intermediate viscoelastic layer 38, is disposed in parallel to a second resilient assembly 40 comprised of resilient elements 42 and 44 which are also joined by a viscoelastic layer 46. An end cap 48 is shown in its fully extended position, corresponding to the absence of hydrostatic pressure on the acoustic baffle assembly. A first region 45 of the end cap provides for separation of the resilient members until the maximum operating pressure is reached. FIG. 5B shows a corresponding view under the maximum design hydrostatic pressure, wherein the lenticular plate assemblies 34 and 40 have been compressed until the facing elements 37 and 42 meet, with the resilient end cap assuming a compressed shape 50. The compressible end caps provide lateral containment of the members without restricting deflection in response to pressure loading by the sea water. This compressibility feature of the design prevents the build-up of bending stress in the longitudinal direction of the spring elements.

Since the plates experience bending stresses primarily in the circumferential direction, the design can be optimized by the use of high strength unidirectional fiber materials wherein the fibers are oriented in the circumferential direction. Accordingly, preferred materials are glass or carbon filament wound shells, unidirectional filament laminates, or compression molded unidirectional fiber-filled resins. These materials exhibit high allowable (flexure stress)$^2$/flexure modulus ratios, which is desirable since this yields the greatest deflection per unit thickness. The invention is, however, applicable to other non-metals as well as metals, but since the ratios of (flexure stress)$^2$/flexure modulus are not as high, they are not as efficient.

Figure 6:
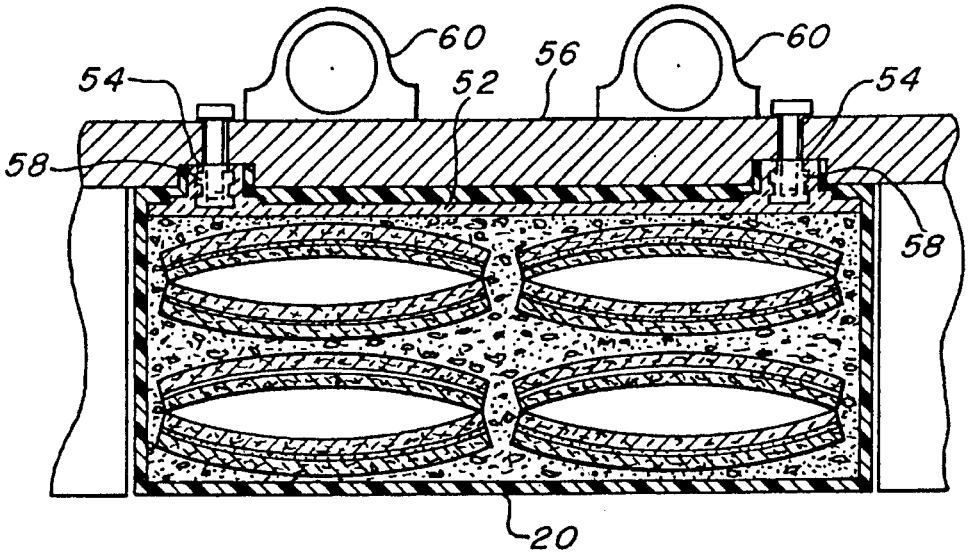
FIG. 6 is a detailed sectional view of the acoustic baffle of FIG. 2 showing a baffle assembly including a mounting plate for affixing to a hydrophone structure.

The baffle assembly can be fixed to a hydrophone array by bonding to the surface 17 of containment jacket 20 with adhesives; however, to facilitate its removal and replacement, the assembly may also be configured to be bolt mounted. Referring now to FIG. 6, there is shown such a configuration with the baffle having a mounting plate 52 which is embedded within the encapsulating jacket 20. Hydrophone sensors 60 receive the desired sound waves underwater. Protruding through the jacket 20 are several foot pads 54 which are internally threaded to provide for affixing to the hydrophone structure 56 by bolting. Integrally contained within the foot pads during the molding process are metal inserts 58 with internal threads. The inserts, which may be comprised of any corrosion resistant metal such as monel, inconel, or type 316 stainless steel, provide the hardness and strength necessary for bolt engagement. The preferred material for the plate 52 is molded glass reinforced plastic (GRP) resin, because of its strength, lightness, resistance to sea water and excellent adhesion to the encapsulated materials.

In operation, each shell pair is designed to deflect equally in response to an impinging acoustic pressure wave. The overall deflection profile, however, will vary depending on the hydrostatic pressure or depth of operation. In one model, with a 600 psi load on the baffle assembly, each of the four shell pairs had a deflection of about 0.313 in., with a total average deflection (including containment 16) between top and bottom faces of 1.57 in. Each shell approximates a simply-supported beam being subjected to a uniformly distributed pressure load. The curved assembly is designed to deflect and achieve a straightened or bottoming position (with both resilient members touching) at maximum operating pressure. Each end of the spring assembly is aligned and sealed by the end caps. The surrounding compliant elastomer provides containment of the spring assemblies and additional compliance at shallow to medium depth operations. The overall core assembly is positioned on a rigid plate with threaded inserts to facilitate attachment to the hydrophone array structure. As noted, the core and plate are encapsulated in a solid cast polyurethane to resist the effects of prolonged immersion in sea water.

The invention allows for application to a range of maximum depth operations and performance levels by selection of the shell design parameters (such as material, thickness, span, etc.). The design is applicable to operational pressures up to and exceeding 1,000 psi. Acoustic tests on the invention described have resulted in performance levels of over 20 dB uniform noise reduction over several octave bands.

Figure 7:
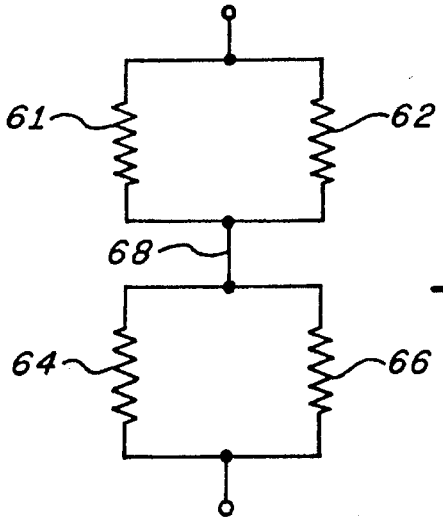
FIG. 7 is a schematic depiction of the mechanical spring equivalent of the resilient elements of FIG. 3.

As was shown in FIG. 3, the resilient members are comprised of an assembly of individual curved resilient elements and an internal viscoelastic layer which are bonded by a flexible adhesive. Since each of the springs in the assembly is bonded to a flexible viscoelastic layer, they act together as two springs in parallel; therefore, they need only support one-half of the applied pressure load. A spring analogy of the design is illustrated in FIG. 7 which shows the parallel arrangement of resilient elements 61 and 62 in the upper half and elements 64 and 66 in the lower half. The pairs are in turn joined together in a series arrangement at node 68 which results in the total deflection of the assembly to be equal to the sum of the deflection of each element pair. Significant advantages result from this configuration. In addition to each resilient element being subjected to one-half the load, its smaller thickness (when compared to one piece design) results in a much lower level of horizontal shearing stress for the same flexure stress and deflection. This is a critical design parameter, particularly when the spring plates are fabricated of the preferred light-weight laminates, since their failure mode is likely to be due to delamination brought about by horizontal shearing stress. Another feature of the design is that the curved resilient elements deflect linearly under application of the uniformly distributed hydrostatic pressure to a bottoming configuration with the resilient pairs straightened and both halves of the assembly touching. This allows the design of the resilient elements to be optimized for the maximum operating depth. Subjection of the baffle to test depths greater than equivalent operating depth pressure would not result in an increase in bending stress. Although such an increase in pressure will result in an increase in compressive stresses in the members, their relatively low levels are not a likely cause of failure.

The sandwich construction of the resilient element pairs and internal viscoelastic layer is designed to provide a considerable measure of resonant damping of the structure by the effective constrained layer damping method. This results from the high shear energy absorbed by the viscoelastic layer due to the relative motion of the constraining resilient elements under deflection. This is a significant feature of the invention, since high damping of the spring elements is one of the most critical factors which negate the detrimental effects of anti-resonances which can be expected if a baffle is operative over a wide receiving frequency range.

A preferred material for sealing the end cap and resilient elements is polysulphide rubber, such as MIL-S-8802, Type II, Class B2, which may be obtained from the Products Research and Chemical Co., Gloucester, N.J. A suitable material for embedding the resilient members is a Adiprene L-100 polyurethane, as manufactured by Uniroyal Chemical Co., Inc., Middlebury, Conn. The viscoelastic damping layer may be obtained as Dyad Part No. 601 from Soundcoat, Deer Park, N.Y. The damping layer may be bonded to the resilient elements using a flexible epoxy adhesive such as B-Flex, also as manufactured by Soundcoat. The water resistant jacket is formed of CC 105 polyurethane, as manufactured by Conap Inc. of Olean, N.Y.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A compliant acoustic baffle for reflecting sound waves in a liquid medium, comprising:

a fluid impermeable enclosure of a first compressible medium and defining a first planar baffle face, an assembly of lenticular-shaped resilient members within said enclosure and disposed in parallel with said baffle face for controlling the compliance of said acoustic baffle by symmetrically and proportionately deflecting in response to hydrostatic pressure loading from said liquid medium, said lenticular-shaped resilient members embedded within a second compressible medium for providing compliance at a first operating pressure, said members having a predetermined compliance such that a maximum deflection is achieved at a second operating pressure, wherein said resilient members are comprised of complementary first and second resilient members having opposing convex faces and first and second ends circumferentially disposed therefrom, and disposed to provide said lenticular shape, each of said members comprised of a pair of first and second resilient elements with a viscoelastic damping layer bonded therebetween, so that upon response to hydrostatic pressure said elements are caused to flatten in proportion to said pressure until at said predetermined maximum pressure said first and second members are in contact at points intermediate said faces, said viscoelastic layer providing resonant damping over a predetermined range of operating frequencies.

2. An acoustic baffle as set forth in claim 1, further comprising a compliant end cap adjoining corresponding ends of each of said resilient members for laterally containing said first and second pairs and allowing deflection of said members without constraint upon the relative motion of said ends.

3. An acoustic-baffle as set forth in claim 2, further comprising means for sealing longitudinal edges of said pairs of elements with a resilient compound, for assuring unitary deflection of each of said pairs.

4. An acoustic baffle as set forth in claim 3, wherein said assembly of members is disposed within said second compressible medium to form a plurality of horizontally or vertically disposed and separated sound-reflecting member pairs.

5. An acoustic baffle as set forth in claim 4, wherein said fluid impermeable enclosure further comprises first and second baffle faces, said first face including mounting means for affixing to an outboard hydrophone array for sensing external sound waves and said second face disposed inboard within said liquid medium so as to have said baffle reflect noise impinging on said second surface of said enclosure.

6. An acoustic baffle as set forth in claim 5, wherein said resilient elements comprise a curved spring plate and said spring plate is comprised of a plastic laminate.

7. An acoustic baffle as set forth in claim 6, wherein said first compressible medium is a compliant material comprised of polyurethane elastomer.

8. An acoustic baffle as set forth in claim 7, wherein said second compressible medium is a compliant material comprised of high density polyurethane cellular foam.

9. An acoustic baffle as set forth in claim 8, wherein said viscoelastic layer is comprised of the group consisting of rubber and vinyl compounds which exhibit a high damping factor.

10. An acoustic baffle as set forth in claim 9, wherein said compliant end cap is comprised of high density cellular polyurethane foam material, and providing a first region of compliant material for separating pairs of complementary resilient members from contact until said second operating pressure is reached and a second region of compliant material integrally formed thereof and securing corresponding ends of said resilient members from longitudinal displacement while allowing deflection of said members in response to pressure loading from said liquid medium.

* * * * *